US007677689B2

(12) United States Patent
Kim et al.

(10) Patent No.: US 7,677,689 B2
(45) Date of Patent: Mar. 16, 2010

(54) METHOD OF MEASURING VOLUMES OF INK DROPLETS AND METHOD OF CONTROLLING NOZZLES OF INKJET HEAD USING THE METHOD

(75) Inventors: Wou-sik Kim, Seoul (KR); Byung-hun Kim, Suwon-si (KR); Sang-il Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 344 days.

(21) Appl. No.: 11/858,470

(22) Filed: Sep. 20, 2007

(65) Prior Publication Data

US 2008/0278534 A1 Nov. 13, 2008

(30) Foreign Application Priority Data

May 9, 2007 (KR) ..... 10-2007-0045104

(51) Int. Cl.
*B41J 29/393* (2006.01)

(52) U.S. Cl. ..... 347/19

(58) Field of Classification Search ..... 347/9–11, 347/14, 19; 358/504
See application file for complete search history.

(56) References Cited

U.S. PATENT DOCUMENTS

| | | | | |
|---|---|---|---|---|
| 6,347,857 | B1 * | 2/2002 | Purcell et al. | 347/19 |
| 6,722,751 | B2 * | 4/2004 | Barr et al. | 347/19 |
| 6,799,819 | B2 * | 10/2004 | Samii | 347/3 |

FOREIGN PATENT DOCUMENTS

| | | |
|---|---|---|
| JP | 2003-265996 | 9/2003 |
| JP | 2006-240048 | 9/2006 |
| JP | 2006-256220 | 9/2006 |

* cited by examiner

*Primary Examiner*—Lamson D Nguyen
(74) *Attorney, Agent, or Firm*—Stanzione & Kim LLP

(57) ABSTRACT

A method of measuring the volumes of ink droplets is provided that includes repeatedly forming print patterns each including a plurality of ink droplets ejected from the inkjet head, photographing ink droplets which correspond to each other in terms of ejection order among the ink droplets of the repeatedly formed print patterns and measuring the volumes of the photographed ink droplets.

25 Claims, 8 Drawing Sheets

METHOD OF MEASURING VOLUMES OF INK DROPLETS AND METHOD OF CONTROLLING NOZZLES OF INKJET HEAD USING THE METHOD

CROSS-REFERENCE TO RELATED APPLICATIONS

This application claims priority under 35 U.S.C. §119(a) from Korean Patent Application No. 10-2007-0045104, filed on May 9, 2007, in the Korean Intellectual Property Office, the disclosure of which is incorporated herein in its entirety by reference.

BACKGROUND OF THE INVENTION

1. Field of the Invention

The present general inventive concept relates to a method of measuring volumes of ink droplets ejected from nozzles of an inkjet head and a method of controlling the nozzles of the inkjet head using the method.

2. Description of the Related Art

In general, inkjet heads are devices that eject ink droplets onto desired positions of a recording medium to form an image. Inkjet heads are categorized into two types according to the ink ejection mechanism thereof. The first one is a thermal inkjet head that ejects ink droplets due to an expansion force of bubbles generated in ink by thermal energy. The other one is a piezoelectric inkjet head that ejects ink droplets due to pressure applied to ink due to deformation of a piezoelectric body.

Inkjet heads have recently been used in image forming and other fields. For example, inkjet heads have been used to manufacture color filters of liquid crystal displays (LCDs). Color filters have been manufactured by dyeing, pigment dispersion, printing, and electrodeposition. However, since these methods need a separate process for each color pixel, process efficiency is low and manufacturing cost is high. Thus, a method of manufacturing a color filter using inkjet printing has recently been developed to simplify a manufacturing process and reduce manufacturing costs. This method manufactures a color filter by ejecting colored ink droplets, e.g., red (R), green (G), and blue (B) ink droplets, through nozzles of an inkjet head into pixels. In addition, inkjet heads can be used to form an organic light emitting layer of an organic light emitting diode (OLED) or an organic semiconductor material of an organic thin film transistor (OTFT).

Various methods of ejecting the same amount of ink from nozzles of an inkjet head during printing have been suggested. One method is to normalize the speed of each of ink droplets ejected from nozzles. Another method is to normalize the mass of each of inkjet droplets ejected from nozzles. Another method is to normalize the volume of each of ink droplets ejected from nozzles. Also, a method of controlling the amount of ink by controlling a pulse duration or a voltage applied to nozzles has been suggested.

FIGS. 1A and 1B illustrate a conventional method of normalizing the volume of ink droplets 1*a*, 1*b*, and 1*c* respectively ejected from nozzles N1, N2, and N3 of an inkjet head 10 using a strobe stand. FIG. 1B is a view obtained by rotating FIG. 1A by 90 degrees. In FIGS. 1A and 1B, the ink droplets 1*a*, 2*a*, and 3*a* may be simultaneously ejected from all the nozzles N1, N2, and N3 of the inkjet head 10.

Referring to FIGS. 1A and 1B, using a light source 20 and a camera 30 disposed on either side of the ink droplets 1*a* ejected from the nozzle N1, when the light source 20 is synchronized with the nozzle N1 that operates at a specific frequency, an image of an ink dot which is formed by overlapping the ink droplets 1*a* is captured by the camera 30. For example, when the nozzle N1 operates at a frequency of 1 kHz and the camera 30 has a shutter speed of 1/30 sec, an image of one ink dot which is formed by overlapping approximately 30 ink droplets is captured by the camera 30. The volume of one ink droplet 1*a* ejected from the nozzle 1A can be calculated from the image, and thus a desired volume of each ink droplet 1*a* can be calculated by controlling a voltage applied to the nozzle N1 or by controlling a pulse duration. This process is repeated for the other nozzles N2 and N3. Accordingly, the same amount of ink can be ejected from all the nozzles N1, N2, and N3 of the inkjet head 10.

However, there is a limitation in applying the conventional method to printing technologies. The conventional method should simultaneously eject the ink droplets 1*a*, 1*b*, and 1*c* at regular time intervals from all the nozzles N1, N2, and N3 of the inkjet head 10, and can eject the same amount of ink from the nozzles N1, N2, and N3 only when pitches between print patterns formed by the nozzles N1, N2, and N3 are equal to pitches between the nozzles N1, N2, and N3, that is, when printing is performed in a state where the nozzles N1, N2, and N3 of the inkjet head 10 are arranged in a direction perpendicular to a print direction. However, it is rare for the ink droplets 1*a*, 1*b*, and 1*c* to be simultaneously ejected at regular time intervals from all the nozzles N1, N2, and N3 of the inkjet head 10. Also, if the pitches between the print patterns are narrower than the pitches between the nozzles N1, N2, and N3, the nozzles N1, printing is performed in a state where the nozzles N1, N2, and N3 of the inkjet head 10 are angled by a predetermined amount with respect to the print direction.

In general, the amount of ink ejected from an inkjet head varies depending on the number of nozzles that simultaneously eject ink, and cross-talk between the nozzles due to relative ejection timings of the nozzles, as well as the nature of ink and the structure of the inkjet head. Accordingly, although the same waveform is applied to the same nozzle, when the number of nozzles simultaneously ejecting ink or when an ink ejection timing is changed, different amounts of ink are ejected from the nozzles. Therefore, although the same amount of ink is expected to be ejected from the nozzles N1, N2, and N3 using the conventional method of FIGS. 1A and 1B, different amounts of ink are ejected from the nozzles N1, N2, and N3 in an actual printing process. Such a difference in amount may not be a serious problem in general image forming/printing, but may be a serious problem in more specialized fields of printing, such as color filter printing, in which the amount of ink should be precisely controlled.

SUMMARY OF THE INVENTION

The present general inventive concept provides a method of measuring volumes of ink droplets ejected from nozzles of an inkjet head during printing, and a method of controlling the nozzles of the inkjet head using the method.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing a method of measuring volumes of ink droplets ejected from an inkjet head, the method including repeatedly forming print patterns each including a plurality of ink droplets ejected from the inkjet head. photographing ink droplets which correspond to each other in terms of an ejection order among the ink droplets of the repeatedly formed print patterns and measuring the volumes of the photographed ink droplets.

The ink droplets which correspond to each other in terms of the ejection order among the ink droplets of the repeatedly formed print patterns may have a same volume and a same ejection speed.

The print patterns may be formed by sequentially ejecting a predetermined number of ink droplets from predetermined nozzles of the inkjet head. The print patterns may be repeatedly formed at regular intervals.

The volumes of the ink droplets which correspond to each other in terms of the ejection order may be measured by a strobe stand including a light source and a camera. The volumes of the ink droplets which correspond to each other in terms of the ejection order may be measured from an image captured by the camera after the light source is synchronized with the ink droplets which correspond to each other in terms of the ejection order.

The volumes of the ink droplets which correspond to each other in terms of the ejection order may be measured by a high speed camera.

The foregoing and/or other aspects and utilities of the general inventive concept may also be achieved by providing a method of controlling nozzles of an inkjet head, the method including repeatedly forming print patterns each including a plurality of ink droplets ejected from the nozzles of the inkjet head, photographing only ink droplets which correspond to each other in terms of an ejection order among ink droplets of the print patterns, measuring the volumes of the photographed ink droplets and determining driving waveforms of the nozzles corresponding to the print patterns using the measured volumes.

The driving waveforms of the nozzles may be determined by controlling at least one of voltages applied to the nozzles and pulse durations.

The determining of the driving waveforms of the nozzles may include measuring the volumes of the ink droplets of the print pattern and calculating an average volume of the volumes of the ink droplets and controlling the driving waveforms of the nozzles corresponding to the print patterns so that the average volume of the volumes of the ink droplets is equal to a target volume.

The determining of the driving waveforms of the nozzles may include measuring the volumes of the ink droplets of the print patterns and controlling the driving waveforms of the nozzles corresponding to the print patterns so that a sum of the volumes of the ink droplets is equal to a target sum.

The foregoing and/or other aspects and utilities of the general inventive concept may also be achieved by providing method of measuring uniformity of ink droplets corresponding to an inkjet printhead having a plurality of nozzles, the method including forming a first print pattern by a respective nozzle of the inkjet printhead discharging a first sequence of ink droplets, forming a second print pattern substantially similar to the first print pattern by the respective nozzle of the inkjet printhead discharging a second sequence of ink droplets, comparing each ink droplet of the first sequence with a corresponding ink droplet of the second sequence and measuring a volume for each of the compared ink droplets of the first sequence and the second sequence.

The foregoing and/or other aspects and utilities of the general inventive concept may also be achieved by providing a computer-readable recording medium having embodied thereon a computer program to execute a method, wherein the method comprises forming a first print pattern by a respective nozzle of the inkjet printhead discharging a first sequence of ink droplets, forming a second print pattern substantially similar to the first print pattern by the respective nozzle of the inkjet printhead discharging a second sequence of ink droplets, comparing each ink droplet of the first sequence with a corresponding ink droplet of the second sequence and measuring a volume for each of the compared ink droplets of the first sequence and the second sequence.

The foregoing and/or other aspects and utilities of the general inventive concept may also be achieved by providing an inkjet printing system including an inkjet printhead having a plurality of nozzles to form a first print pattern by discharging a first sequence of ink droplets, and to form a second print pattern substantially similar to the first print pattern by discharging a second sequence of ink droplets, and a measuring unit disposed proximate to the inkjet printhead to compare each ink droplet of the first sequence with a corresponding ink droplet in the second sequence, and to measure a volume for each of the compared ink droplets of the first sequence and the second sequence.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
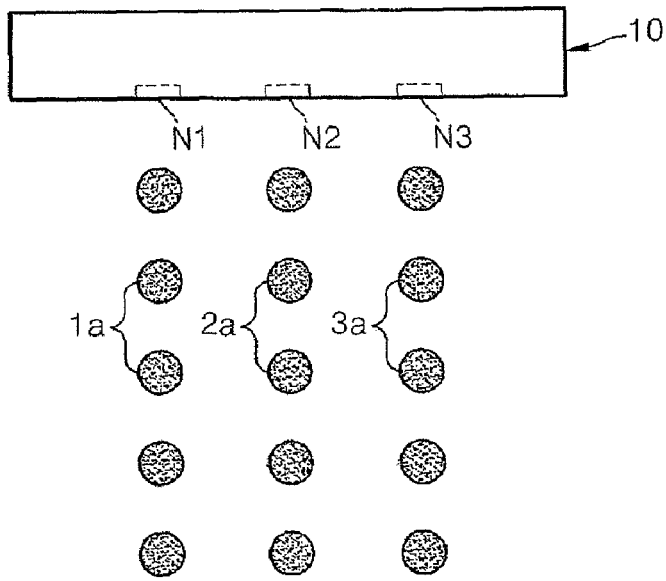
FIG. 1A (PRIOR ART)
FIGS. 1A and 1B illustrate a conventional method of normalizing volumes of ink droplets ejected from nozzles of an inkjet head using a strobe stand.
Figure 1B:
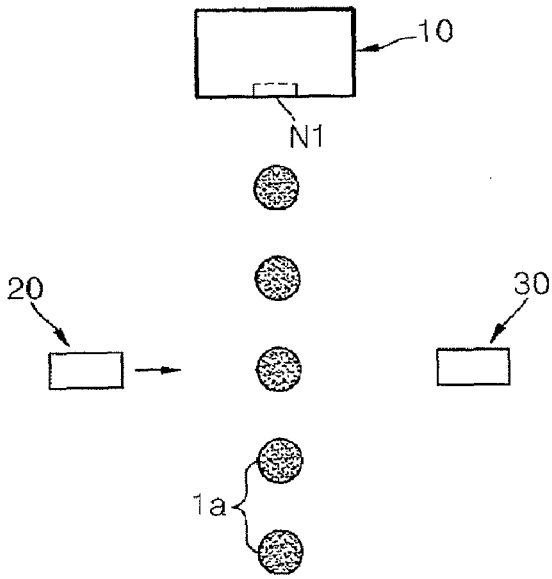
FIG. 1B (PRIOR ART)

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
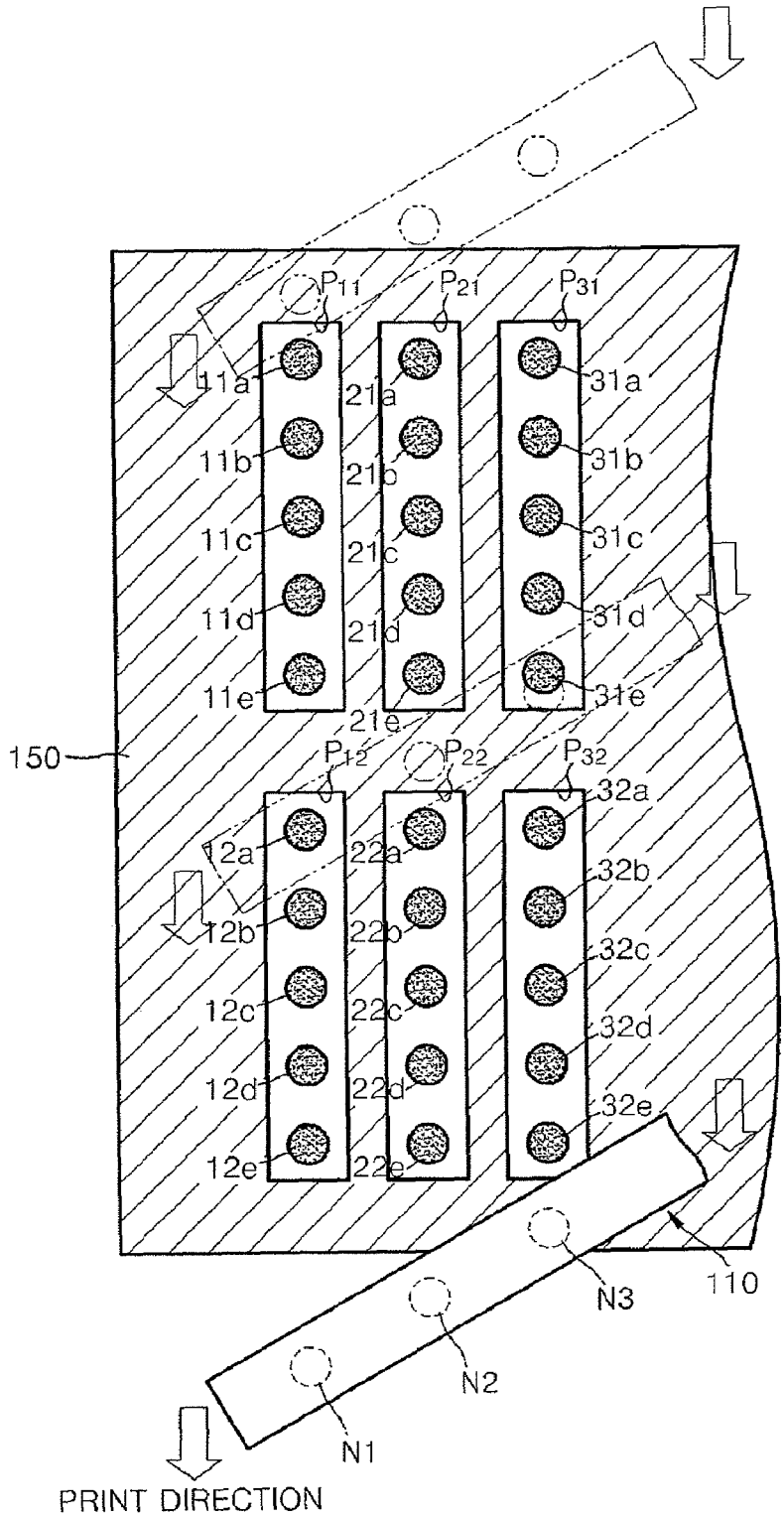
FIG. 2 illustrates an inkjet head performing a printing process in pixels while moving in a print direction to form a color filter.

FIG. 2 illustrates an inkjet head 110 to perform a printing process printing in pixels while moving in a print direction and ejecting ink droplets to form a color filter.

Referring to FIG. 2, a plurality of pixels P11, P12, P21, P22, P31, and P32 partitioned by a black matrix 150 are formed at predetermined intervals on a substrate (not illustrated). Printing is performed by ejecting ink droplets from nozzles N1, N2, and N3 of the inkjet head 110 into the pixels P11, P12, P21, P22, P31, and P32. In FIG. 2, since a pixel pitch, for example, a pitch between the pixel P11 and P21, is narrower than a nozzle pitch, for example, a pitch between the nozzle N1 and the nozzle N2, printing is performed in a state where the inkjet head 110 is angled by a predetermined amount with respect to the print direction. That is, the inkjet head 110 performs printing while moving in the print direction in a state where the nozzles N1, N2, and N3 are angled with respect to the print direction.

Predetermined pixel patterns are repeatedly printed in the pixels P11, P12, P21, P22, P31, and P32 by the nozzles N1, N2, and N3 of the inkjet head 110 in the present embodiment. Each of the pixel patterns is printed by a predetermined number of ink droplets ejected from its corresponding nozzle. While each of the pixel patterns is printed by five ink droplets in FIG. 2, the present embodiment is not limited thereto.

The inkjet head 110 angled with respect to the print direction performs printing by ejecting ink droplets from the nozzles N1, N2, and N3 while moving in the print direction. In this process, ink droplets 11*a*, 11*b*, 11*c*, 11*d*, and 11*e* are sequentially ejected from the nozzle N1, and a predetermined pixel pattern is printed in the pixel P11 by the ejected ink droplets 11*a*, 11*b*, 11*c*, 11*d*, and 11*e*. The pixel pattern is repeatedly printed in the pixel P12 after the inkjet head 110 moves by a predetermined distance in the print direction. That is, five ink droplets 12*a*, 12*b*, 12*c*, 12*d*, and 12*e* are sequentially ejected from the nozzle N1 while the inkjet head 110 moves in the print direction, and a pixel pattern, which is the same pixel pattern as the pixel pattern formed in the pixel P11, is printed in the pixel P12 by the ejected ink droplets 12*a*, 12*b*, 12*c*, 12*d*, and 12*e*. Each of the ink droplets 11*a* and 12*a*, the ink droplets 11*b* and 12*b*, the ink droplets 11*c* and 12*c*, the ink droplets 11*d* and 12*d*, and the ink droplets 11*e* and 12*e* correspond to each other in ejection order. Accordingly, the same pixel pattern is repeatedly printed in the print direction in the pixels P11 and P12 corresponding to the nozzle N1. The repeated printing of the same pixel pattern is performed for the other nozzles N2 and N3. In FIG. 2, reference numerals 21*a*, 21*b*, 21*c*, 21*d*, and 21*e* denote ink droplets ejected from the nozzle N2 and printing a predetermined pixel in the pixel P21, and reference numerals 22*a*, 22*b*, 22*c*, 22*d*, and 22*e* denote ink droplets ejected from the nozzle N2 and repeatedly printing the same pixel pattern in the pixel P22. Reference numerals 31*a*, 31*b*, 31*c*, 31*d*, and 31*e* denote ink droplets ejected from the nozzle N3 and printing a predetermined pixel pattern in the pixel P31, and reference numerals 32*a*, 32*b*, 32*c*, 32*d*, and 32*e* denote ink droplets ejected from the nozzle N3 and repeatedly printing the same pixel pattern in the pixel P32.

While the inkjet head 110 performs printing while moving in the print direction over the fixed substrate in FIG. 2, the present embodiment is not limited thereto and the inkjet head 110 may be fixed and perform printing on a movable substrate to form a color filter.

Figure 3:
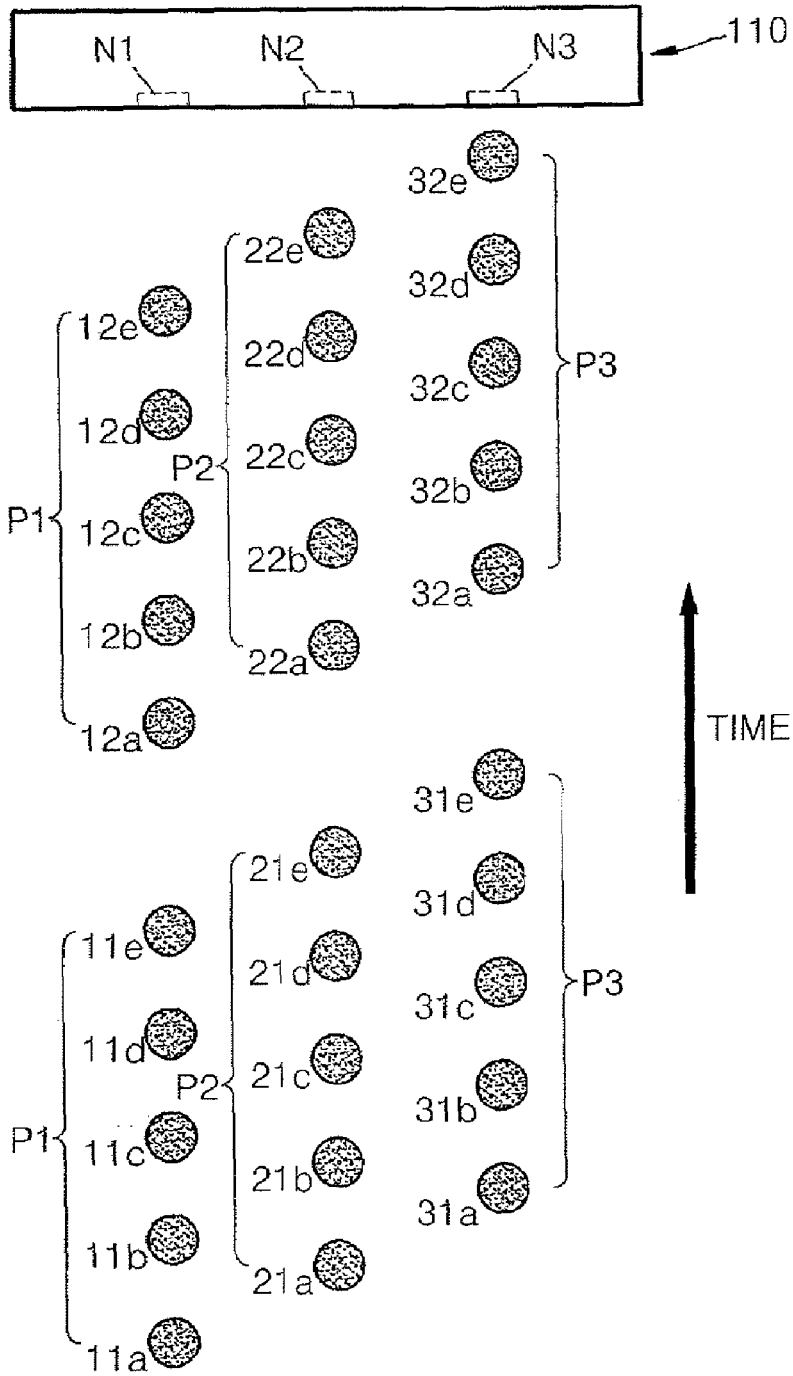
FIG. 3 illustrates ink droplets sequentially ejected from nozzles of the inkjet head of FIG. 2.

FIG. 3 illustrates the ink droplets sequentially ejected from the nozzles N1, N2, and N3 of the inkjet head 110 of FIG. 2.

Referring to FIG. 3, the ink droplets 11*a*, 21*a*, 11*b*, 31*a*, 21*b*, 11*c*, . . . , 12*a*, 22*a*, 12*b*, 32*a*, . . . are sequentially ejected from the nozzles N1, N2, and N3. In this process, print patterns P1, P2, and P3 respectively corresponding to the nozzles N1, N2, and N3 are repeatedly formed at regular intervals. The print patterns P1, P2, and P3 each include a plurality of ink droplets sequentially ejected from their corresponding nozzles N1, N2, and N3. In detail, the ink droplets 11*a*, 11*b*, 11*c*, 11*d*, and 11*e* are sequentially ejected from the nozzle N1 to form the print pattern P1 corresponding to the nozzle N1, and after a predetermined time interval, the ink droplets 12*a*, 12*b*, 12*c*, 12*d*, and 12*e* are sequentially ejected to repeatedly form the print pattern P1. The ink droplets 21*a*, 21*b*, 21*c*, 21*d*, and 21*e* are sequentially ejected from the nozzle N2 to form the print pattern P2 corresponding to the nozzle N2, and after a predetermined time interval, the ink droplets 22*a*, 22*b*, 22*c*, 22*d*, and 22*e* are sequentially ejected to repeatedly form the print pattern P2. The print pattern P3 is repeatedly formed with the ink droplets ejected from the nozzle N3 in the same manner as described above.

Accordingly, the print patterns P1, P2, and P3 each including a predetermined number of ink droplets are repeatedly formed by the nozzles N1, N2, and N3 of the inkjet head 110. The ink droplets constituting each of the print patterns P1, P2, and P3 may be different from one another in volume and ejection speed. For example, the ink droplets 11*a*, 11*b*, 11*c*, 11*d*, and 11*e* constituting the print pattern P1 formed by the nozzle N1 may have different volumes and different ejection speeds. The ink droplets 12*a*, 12*b*, 12*c*, 12*d*, and 12*e* constituting the print pattern P1 repeatedly formed by the nozzle N1 may have different volumes and different ejection speeds. This is because printing conditions around the nozzle N1 are different at points of time when the ink droplets are ejected. That is, since printing conditions, such as the number of other nozzles, which eject ink at the same time when the nozzle N1 ejects ink, and relative ejection timings between the nozzle N1 and other nozzles, are different at points of time when the ink droplets 11*a*, 11*b*, 11*c*, 11*d*, and 11*e* are ejected, the ink droplets 11*a*, 11*b*, 11*c*, 11*d*, and 11*e* may have different volumes and different ejection speeds.

However, the print patterns P1, P2, and P3 repeatedly formed by the nozzles N1, N2, and N3 are the same. In detail, ink droplets corresponding in ejection order among ink droplets constituting the repeatedly formed print patterns P1, P2, and P3 have the same volume and the same ejection speed. For example, the first ink droplet 11*a* among the ink droplets 11*a*, 11*b*, 11*c*, 11*d*, and 11*e* constituting the print pattern P1 formed by the nozzle N1 and the first ink droplet 12*a* among the ink droplets 12*a*, 12*b*, 12*c*, 12*d*, and 12*e* constituting the print pattern P1 repeatedly formed by the nozzle N1 have the same volume and the same ejection speed. This is because printing conditions around the nozzle N1 at a point in time when the ink droplet 11*a* is ejected are the same as printing conditions around the nozzle N1 at a point in time when the ink droplet 12*a* is ejected. Accordingly, each of the ink droplets 11*b* and 12*b*, 11*c* and 12*c*, 11*d* and 12*d*, and 11*e* and 12*e* corresponding in ejection order have the same volume and the same ejection speed. Also, each of the ink droplets 21*a* and 22*a*, 21*b* and 22*b*, 21*c* and 22*c*, 21*d* and 22*d*, and 21*e* and 22*e* which correspond in ejection order and are ejected by the nozzle N2 have the same volume and the same ejection speed. Each of the ink droplets 31*a* and 32*a*, 31*b* and 32*b*, 31*c* and 32*c*, 31*d* and 32*d*, and 31*e* and 32*e* which correspond in ejection order and are ejected by the nozzle N3 have the same volume and the same ejection speed.

When the print patterns P1, P2, and P3 each including a predetermined number of ink droplets are repeatedly formed at regular intervals by the nozzles N1, N2, and N3 of the inkjet head 110 as illustrated in FIG. 3, the present general inventive concept provides a method of measuring the volumes of the ink droplets constituting the print patterns P1, P2, and P3 and a method of controlling the nozzles N1, N2, and N3 of the inkjet head 110 using the measurement method. In detail, according to the present general inventive concept, the volumes of the ink droplets may be measured by photographing only ink droplets corresponding in ejection order among the ink droplets constituting the print patterns P1, P2, and P3 that are repeatedly formed. The photographing of the ink droplets may be performed by a strobe stand.

FIGS. 4 through 7 illustrate a method of measuring volumes of ink droplets constituting print patterns using a strobe stand including a light source 120 and a camera 130. The light source 120 may be a light emitting diode (LED).

Figure 4:
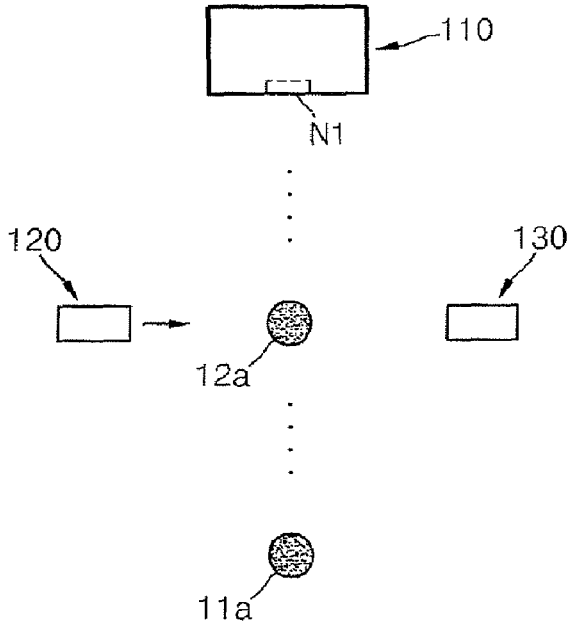
FIGS. 4 through 7 illustrate a method of measuring volumes of the ink droplets of print patterns of FIG. 3 using a strobe stand according to an embodiment of the present general inventive concept.

As described above, the print patterns P1, P2, and P3 repeatedly formed by the nozzles N1, N2, and N3 are the same. In detail, referring to FIG. 3, with respect to nozzle N1, each of the ink droplets 11*a* and 12*a*, 11*b* and 12*b*, 11*c* and 12*c*, 11*d* and 12*d*, and 11*e* and 12*e* corresponding in ejection order among the ink droplets constituting the print pattern P1 that is repeatedly formed have the same volume and the same ejection speed. Accordingly, as illustrated in FIG. 4, the first ink droplets 11*a* and 12*a* among the ink droplets corresponding in ejection order are ejected from the nozzle N1 at a predetermined time interval. Accordingly, when the light source 120 is synchronized with the first ink droplets 11*a* and 12*a*, an image of one ink dot which is formed by overlapping the first ink droplets 11*a* and 12*a* is captured by the camera 130. The volume $V_{1a}$ of each of the first ink droplets 11*a* and 12*a* constituting the print pattern P1 corresponding to the nozzle N1 can be measured from the image.

Figure 5:
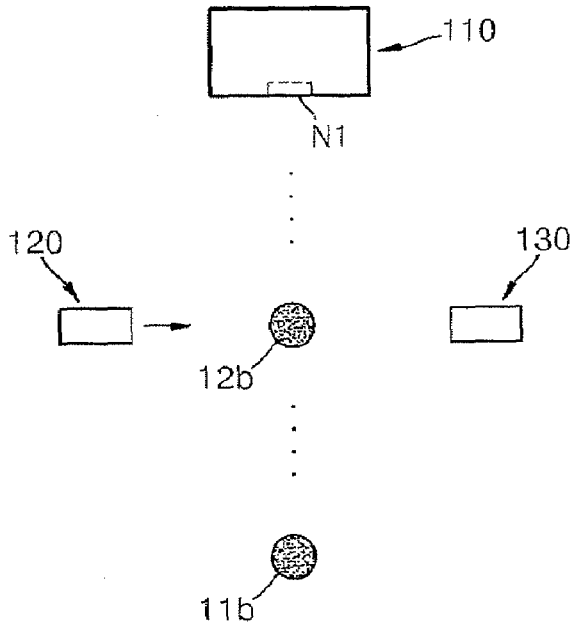

Referring to FIG. 5, the second ink droplets 11*b* and 12*b* among the ink droplets corresponding in ejection order are ejected from the nozzle N1 at a predetermined time interval. Accordingly, when the light source 120 is synchronized with the second ink droplets 11*b* and 12*b*, an image of one ink dot which is formed by overlapping the second ink droplets 11*b* and 12*b* is captured by the camera 130. The volume $V_{1b}$ of each of the second ink droplets 11*b* and 12*b* constituting the print pattern P1 corresponding to the nozzle N1 can be measured from the image. When this process is repeated for the other ink droplets, the volumes $V_{1c}$, $V_{1d}$, and $V_{1e}$ of the third, fourth, and fifth ink droplets constituting the print pattern P1 corresponding to the nozzle N1 can be measured.

After the volumes of the ink droplets constituting the print pattern P1 corresponding to the nozzle N1 are respectively measured, an average volume ($V_1=(V_{1a}+V_{1b}+V_{1c}+V_{1d}+V_{1e})/5$) of the volumes of the ink droplets is calculated. A driving waveform to be applied to the nozzle N1 is determined so that the average volume $V_1$ of the volumes of the ink droplets is equal to a target volume $V_t$. The driving waveform of the nozzle N1 is determined by controlling at least one of a voltage applied to the nozzle N1 and a pulse duration.

Figure 6:
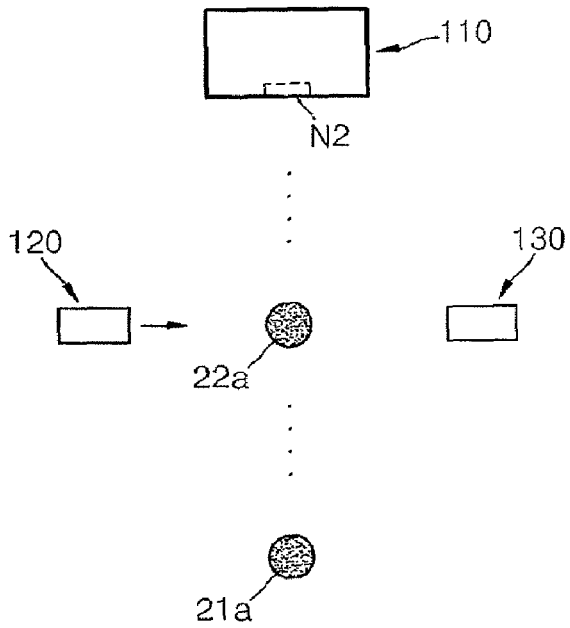

Also, with respect to nozzle N2, each of the ink droplets 21*a* and 22*a*, 21*b* and 22*b*, 21*c* and 22*c*, 21*d* and 22*d*, and 21*e* and 22*e* corresponding in ejection order among the ink droplets constituting the print pattern P2 that is repeatedly formed, have the same volume and the same ejection speed. Referring to FIG. 6, the first ink droplets 21*a* and 22*a* among the ink droplets corresponding in ejection order are ejected from the nozzle N2 at predetermined time intervals. Accordingly, when the light source 120 is synchronized with the first ink droplets 21*a* and 22*a*, an image of one ink dot which is formed by overlapping the ink droplets 21*a* and 22*a* is captured by the camera 130, and the volume $V_{2a}$ of each of the first ink droplets 21*a* and 22*a* constituting the print pattern P2 corresponding to the nozzle N2 can be measured from the image.

Figure 7:
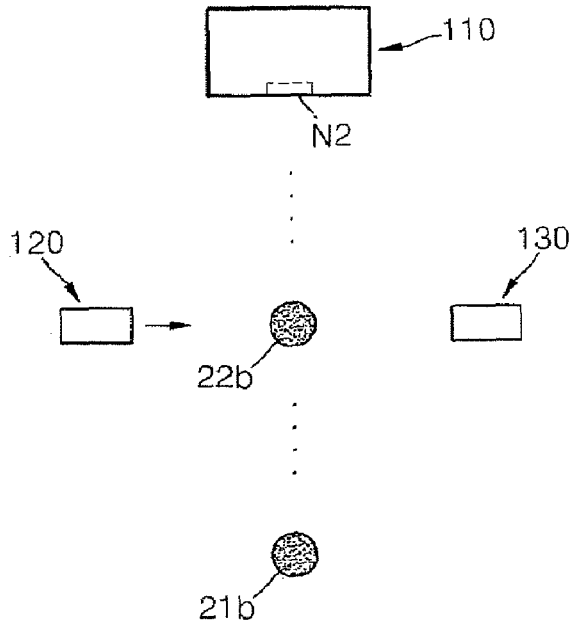

Referring to FIG. 7, the second ink droplets 21*b* and 22*b* among the ink droplets corresponding in ejection order are ejected from the nozzle N2 at a predetermined interval. Accordingly, when the light source 120 is synchronized with the second ink droplets 21*b* and 22*b*, an image of one ink dot which is formed by overlapping the ink second droplets 21*b* and 22*b* is captured by the camera 130, and the volume $V_{2b}$ of each of the second ink droplets constituting the print pattern P2 corresponding to the nozzle N2 can be measured from the image. When the process is repeated for the other ink droplets, the volumes $V_{2c}$, $V_{2d}$, and $V_{2e}$ of the third, fourth, and fifth ink droplets constituting the print pattern P2 corresponding to the nozzle N2 can be measured.

After the volumes of the ink droplets constituting the print pattern P2 corresponding to the nozzle N2 are measured, an average volume ($V_2=(V_{2a}+V_{2b}+V_{2c}+V_{2d}+V_{2e})/5$) of the volumes of the ink droplets is calculated. A driving waveform to be applied to the nozzle N2 is determined so that the average volume $V_2$ of the volumes of the ink droplets can be equal to a target volume $V_t$. The driving waveform of the nozzle N2 is determined by controlling at least one of a voltage applied to the nozzle N2 and a pulse duration. When the process is repeated for the other nozzle N3, driving waveforms to be applied to the nozzles N1, N2, and N3 of the inkjet head 110 can be determined.

When the determined driving waveforms are applied to the nozzles N1, N2, and N3, the print patterns formed from the nozzles N1, N2, and N3 have the same amount of ink. Accordingly, when the color filter is formed by applying the determined driving waveforms to the nozzle N1, N2, and N3 of the inkjet head 110, ink layers having a uniform thickness can be formed in the pixels of the color filter.

While the driving waveforms of the nozzles N1, N2, and N3 are determined using the average volume of the volumes of the ink droplets in the above, the driving waveforms of the nozzles N1, N2, and N3 may be determined using a sum of the volumes of the ink droplets. That is, after a sum ($V_{1sum}=V_{1a}+V_{1b}+V_{1c}+V_{1d}+V_{1e}$) of the volumes of the ink droplets constituting the print pattern corresponding to the nozzle N1, the driving waveform of the nozzle N1 is determined so that the sum $V_{1sum}$ is equal to a target sum ($V_{tsum}$). When the process is repeated for the other nozzles N2 and N3, the driving waveforms to be applied to the nozzles N1, N2, and N3 can be determined.

While the volumes of the ink droplets constituting the print patterns P1, P2, and P3 are measured using the strobe stand in the present embodiment, the volumes of the ink droplets may be measured in other ways. For example, the volumes of the ink droplets constituting the print patterns P1, P2, and P3 may be measured by photographing only the ink droplets corresponding in ejection order using a high speed camera.

Figure 8:
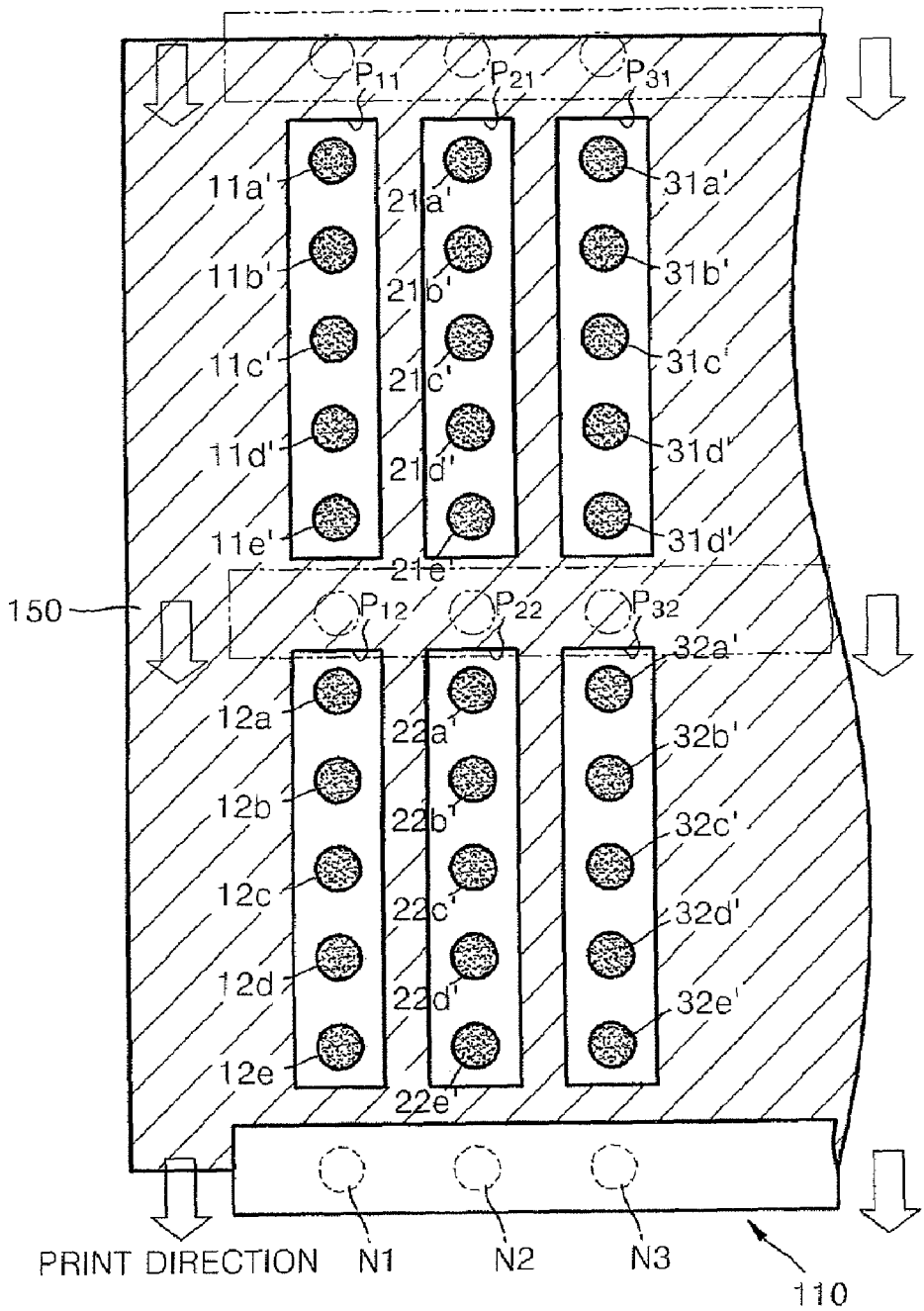
FIG. 8 illustrates another inkjet head performing a printing process in pixels while moving in a print direction to form a color filter.

FIG. 8 illustrates another inkjet head 110 to perform a printing process in pixels while moving in a print direction to form a color filter. The following explanation will be made focusing on a difference from the embodiment of FIGS. 2 and 3.

Referring to FIG. 8, a plurality of pixels P11, P12, P21, P22, P31, and P32 partitioned by a black matrix 150 are formed at predetermined intervals on a substrate (not illustrated). Printing is performed by ejecting ink droplets from the nozzles N1, N2, and N3 of the inkjet head 110 into the pixels P11, P12, P21, P22, P31, and P32. Since a pixel pitch, for example, a pitch between the pixels P11 and P21, is the same as a nozzle pitch, for example, a pitch between the nozzles N1 and N2 in FIG. 8, the inkjet head 110 performs printing in a state where it is disposed in a direction perpendicular to a print direction. That is, the inkjet head 110 performs printing while moving in the print direction in a state where the nozzles N1, N2, and N3 are disposed in the direction perpendicular to the print direction.

Predetermined pixel patterns are repeatedly printed in the pixels P11, P12, P21, P22, and P31, and P32 by the nozzles N1, N2, and N3. Each of the pixel patterns is printed by a predetermined number of ink droplets ejected from each of the nozzles N1, N2, and N3. In detail, ink droplets 11*a*', 11*b*', 11*c*', 11*d*', and 11*e*' are sequentially ejected from the nozzle N1, and a predetermined pixel pattern is printed in the pixel P11 by the ejected ink droplets 11*a*', 11*b*', 11*c*', 11*d*', and 11*e*'. At the same time, ink droplets 21*a*', 21*b*', 21*c*', 21*d*', and 21*e*' are sequentially ejected from the nozzle N2, and a predetermined pixel pattern is printed in the pixel P21 by the ejected ink droplets 21*a*', 21*b*', 21*c*', 21*d*', and 21*e*'. At the same time, ink droplets 31*a*', 31*b*', 31*c*', 31*d*', and 31*e*' are sequentially ejected from the nozzle N3, and a predetermined print pattern is printed in the pixel P31 by the ejected ink droplets 31*a*', 31*b*', 31*c*', 31*d*', and 31*e*'.

Next, the pixel pattern printed by the nozzle N1 is repeatedly printed in the pixel P12 after the inkjet head 110 moves by a predetermined distance in the print direction. Five ink droplets 12*a*', 12*b*', 12*c*', 12*d*', and 12*e*' are sequentially ejected from the nozzle N1, and a predetermined pattern which is the same pixel pattern as the pixel pattern printed in the pixel P11 is repeatedly printed in the pixel P12 by the ejected ink droplets 12*a*', 12*b*', 12*c*', 12*d*', and 12*e*'. Each of the ink droplets 11*a*' and 12*a*', 11*b*' and 12*b*', 11*c*' and 12*c*', 11*d*' and 12*d*', and 11*e*' and 12*e*' correspond in ejection order. Accordingly, the same pixel pattern is repeatedly printed in the print direction in the pixels P11 and P12 corresponding to the nozzle N1. The repeated printing of the pixel pattern is performed for the other nozzles N2 and N3. In FIG. 8, reference numerals 22*a*', 22*b*', 22*c*', 22*d*', and 22*e*' denote ink droplets ejected from the nozzle N2 and printing a predetermined pixel pattern in the pixel P22, and reference numerals 32*a*', 32*b*', 32*c*', 32*d*', and 32*e*' denote ink droplets ejected from the nozzle N3 and printing a predetermined pixel pattern in the pixel P32.

Although the inkjet head 110 performs printing while moving in the print direction over the fixed substrate in FIG. 8, the present embodiment is not limited thereto and the inkjet head 110 may be fixed and perform printing on a movable substrate to form a color filter.

Figure 9:
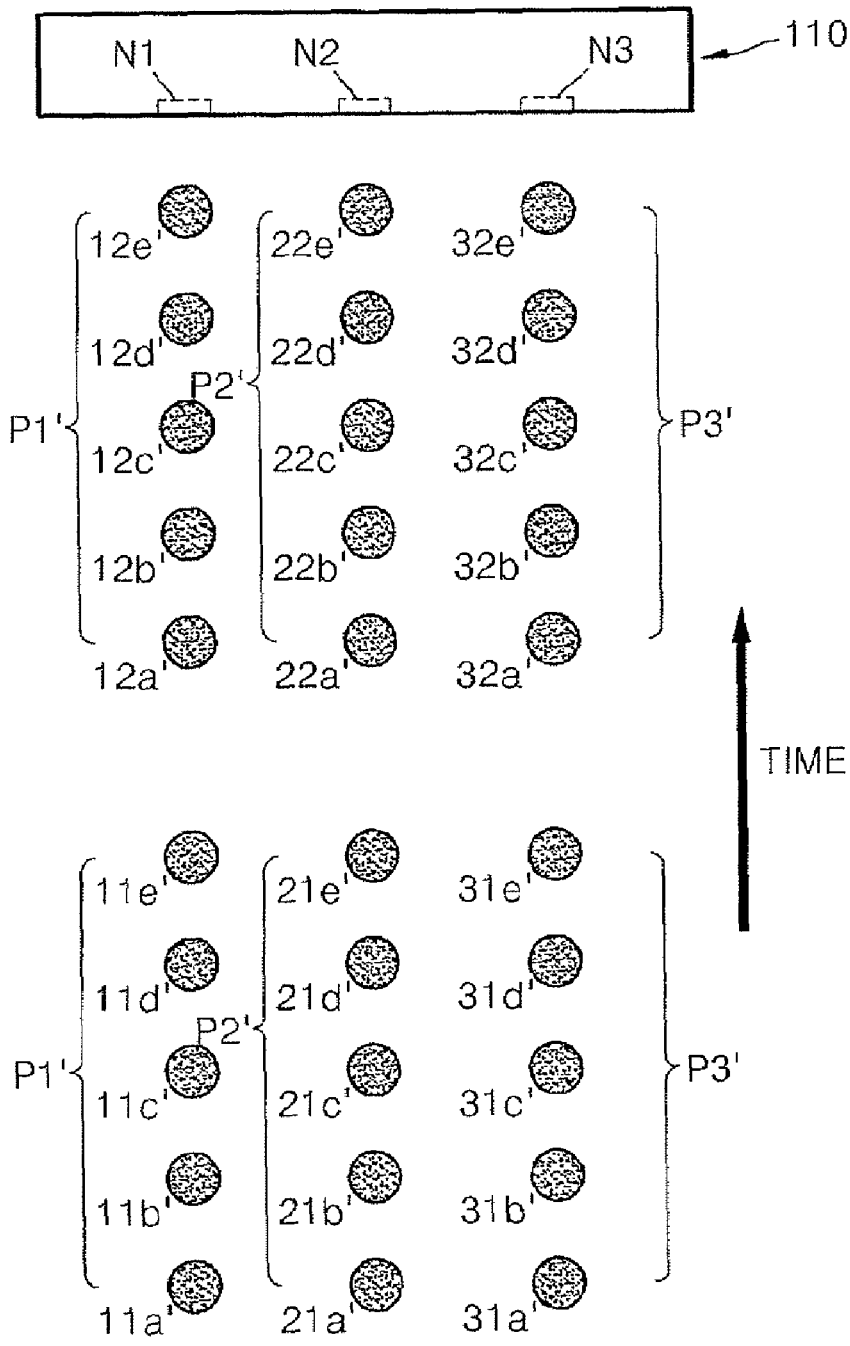
FIG. 9 illustrates ink droplets sequentially ejected from nozzles of the inkjet head of FIG. 8.

FIG. 9 illustrates ink droplets sequentially ejected from the nozzles N1, N2, and N3 of the inkjet head 110 of FIG. 8.

Referring to FIG. 9, the ink droplets 11*a*', 11*b*', 11*c*', 11*d*', . . . are sequentially ejected from the nozzle N1, the inkjet droplets 21*a*', 21*b*', 21*c*', 21*d*', . . . are sequentially ejected from the nozzle N2, and the ink droplets 31*a*', 31*b*', 31*c*', 31*d*', . . . are sequentially ejected from the nozzle N3. The ink droplets 11*a*', 21*a*', and 31*a*' are simultaneously ejected from the nozzles N1, N2, and N3, and the ink droplets 11*b*', 21*b*', and 31*b*' are simultaneously ejected from the nozzles N1, N2, and N3. In this process, the print patterns P1', P2', and P3' respectively corresponding to the nozzles N1, N2, and N3 are repeatedly formed at regular intervals. The print patterns P1', P2', and P3' each include a plurality of ink droplets sequentially ejected from their corresponding nozzles N1, N2, and N3. In detail, with respect to nozzle N1, the ink droplets 11*a*', 11*b*', 11*c*', 11*d*', and 11*e*' are first sequentially ejected from the nozzle N1 to form the print pattern P1' corresponding to the nozzle N1, and after a predetermined time interval, the ink droplets 12*a*', 12*b*', 12*c*', 12*d*', and 12*e*' are sequentially ejected to repeatedly form the print pattern P1'. With respect to nozzle N2, the ink droplets 21'*a*, 21*b*', 21*c*', 21*d*', and 21*e*' are sequentially ejected to form the print pattern P2' corresponding to the nozzle N2, and after a predetermined time interval, the ink droplets 22*a*', 22*b*', 22*c*', 22*d*', and 22*e*' are sequentially ejected to repeatedly form the print pattern P2'. The print pattern P3' is repeatedly formed by the ink droplets ejected from the nozzle N3 in the same manner as described above.

Accordingly, the print patterns P1', P2', and P3' each including a predetermined number of ink droplets are repeatedly formed from the nozzles N1, N2, and N3 of the inkjet head 110. Even when the ink droplets are simultaneously ejected from the nozzles N1, N2, and N3 in this manner, the ink droplets constituting each of the print patterns P1', P2', and P3' may have different volumes and different ejection speeds. For example, the ink droplets 12*a*', 12*b*', 12*c*', 12*d*', and 12*e*' constituting the print pattern P1' formed by the nozzle N1 may have different volumes and different ejection speeds from one another. This is because there is a time delay in which there is no ink ejection after the print pattern P1' is formed by the nozzle N1, and this time delay may affect the volumes and the ejection speeds of the subsequent ink droplets 12*a*', 12*b*', 12*c*', 12*d*', and 12*e*'.

The print patterns P1', P2', and P3' repeatedly formed by the respective nozzles N1, N2, and N3 are equal to each other. That is, the ink droplets corresponding in ejection order among the ink droplets constituting the repeatedly formed print patterns P1', P2', and P3' have the same volume and the same ejection speed. For example, the first ink droplet 1*a*' among the ink droplets 11*a*', 11*b*', 11*c*, 11*d*', and 11*e*' constituting the print pattern P1' formed by the nozzle N1 and the first ink droplet 12*a*' among the ink droplets 12*a*', 12*b*', 12*c*', 12*d*', and 12*e*' constituting the print pattern P1' repeatedly formed by the nozzle N1 have the same volume and the same ejection speed. This is because printing conditions at a point in time when the ink droplet 11*a*' is ejected are the same as printing conditions at a point in time when the ink droplet 12*a*' is ejected. Each of the ink droplets 11*b*' and 12*b*', 11*c* and 12*c*, 11*d* and 12*d*, and 11*e* and 12*e* corresponding in ejection order have the same volume and the same ejection speed. Each of the ink droplets 21*a*' and 22*a*', 21*b*' and 22*b*', 21*c*' and 22*c*', 21*d*' and 22*d*', and 21*e*' and 22*e*' which correspond in ejection order and are ejected from the nozzle N2 have the same volume and the same ejection speed. Each of the ink droplets 31*a*' and 32*a*', 31*b*' and 32*b*', 31*c*' and 32*c*', 31*d*' and 32*d*', and 31*e*' and 32*e*' which correspond in ejection order and are ejected by the nozzle N3 have the same volume and the same ejection speed.

The present general inventive concept may be applied where the print patterns P1', P2', and P3' each including a predetermined number of ink droplets are repeatedly formed at regular intervals by the nozzles N1, N2, and N3 of the inkjet head as illustrated in FIG. 9. According to the present general inventive concept, the volumes of the ink droplets may be measured by photographing only the ink droplets corresponding in ejection order among the ink droplets constituting the print patterns that are repeatedly formed. The photographing of the ink droplets may be performed using a strobe stand.

When the print patterns P1', P2', and P3' each including a predetermined number of ink droplets are repeatedly formed by the nozzles N1, N2, and N3 as illustrated in FIG. 9, the driving waveforms of the nozzles N1, N2, and N3 corresponding to the print patterns P1', P2', and P3' can be controlled by measuring volumes of the ink droplets constituting the print patterns P1', P2', and P3' corresponding to the nozzles N1, N2, and N3. The volumes of the ink droplets constituting the print patterns P1', P2', and P3' may be measured by photographing only the ink droplets corresponding in ejection order among the ink droplets constituting the print patterns P1', P2', and P3' that are repeatedly formed. The ink droplets corresponding in ejection order may be photographed by a strobe stand or a high speed camera, which has already been described above, and thus a detailed description thereof will not be given.

After an average volume of the measured volumes of the ink droplets is calculated, the driving waveforms of the nozzles N1, N2, and N3 are determined so that the average volume is equal to a target volume. The driving waveforms of the nozzles N1, N2, and N3 are determined by controlling at least one of voltages applied to the nozzles N1, N2, and N3 and pulse durations. After a sum of the volumes of the ink droplets is calculated, the driving waveforms of the nozzles N1, N2, and N3 may be determined so that the sum is equal to a target sum.

When the determined driving waveforms are applied to the nozzles N1, N2, and N3, the print patterns formed by the nozzles N1, N2, and N3 have the same amount of ink. Accordingly, when the color filter is formed by applying the determined driving waveforms to the nozzles N1, N2, and N3 of the inkjet head 110, ink layers having a uniform thickness can be formed in the pixels of the color filter.

Figure 10:
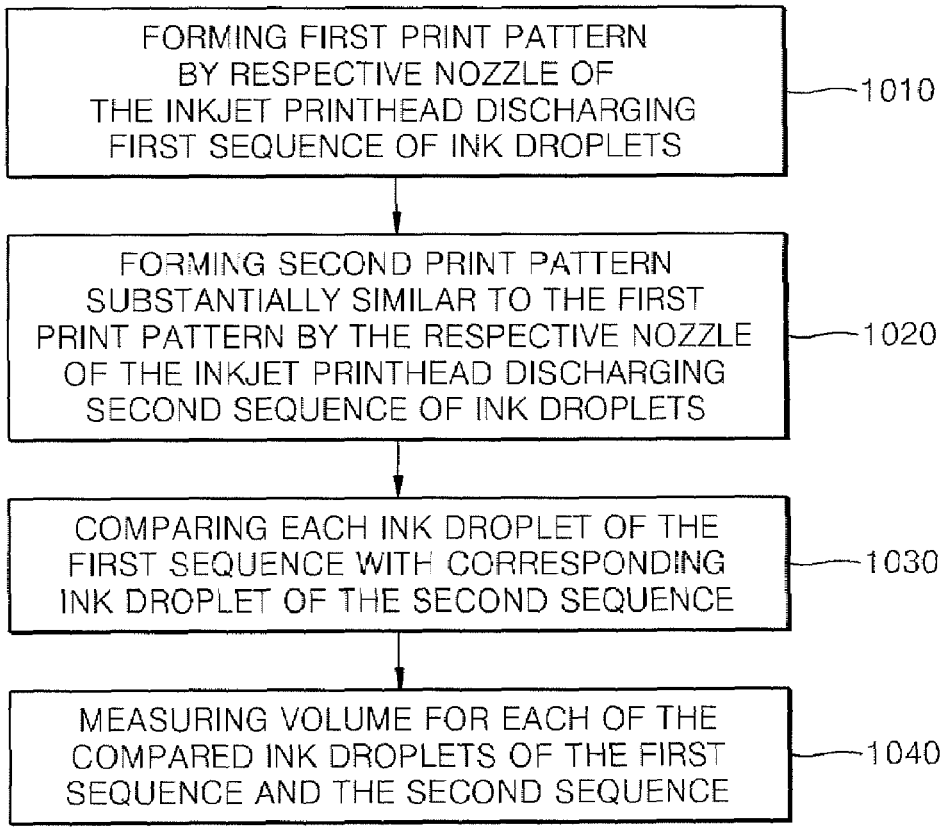
FIG. 10 is a flowchart illustrating a method of measuring uniformity of ink droplets corresponding to an inkjet head having a plurality of nozzles according to an embodiment of the present invention.

FIG. 10 is a flowchart illustrating a method of measuring uniformity of ink droplets corresponding to an inkjet head having a plurality of nozzles according to an embodiment of the present invention. Referring to FIG. 10, in operation 1010, a first print pattern is formed by a respective nozzle of the inkjet head discharging a first sequence of ink droplets. In operation 1020, a second print pattern substantially similar to the first print pattern is formed by the respective nozzle of the inkjet head discharging a second sequence of ink droplets. In operation 1030, each ink droplet of the first sequence is compared with a corresponding ink droplet of the second sequence. In operation 1040, a volume for each of the compared ink droplets of the first sequence and the second sequence are measured.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Also, the present general inventive concept can be applied where print patterns each including a predetermined number of ink droplets are repeatedly formed by nozzles of an inkjet head. For example, the present general inventive concept can be applied to a printing method to form an organic light emitting layer of an organic light emitting diode (OLED) or a printing method to form an organic semiconductor material of an organic thin film transistor (OTFT).

As described above, according to the method of controlling the nozzles of the present general inventive concept, the inkjet head can uniformly eject ink droplets constituting print patterns to repeatedly form the same print pattern. Accordingly, the ink layers formed in the pixels of the color filter can have a uniform thickness.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A method of measuring volumes of ink droplets ejected from an inkjet head, the method comprising:

repeatedly forming print patterns each including a plurality of ink droplets ejected from the inkjet head;

photographing ink droplets which correspond to each other in terms of an ejection order among the ink droplets of the repeatedly formed print patterns; and measuring the volumes of the photographed ink droplets.

2. The method of claim 1, wherein the ink droplets which correspond to each other in terms of the ejection order among the ink droplets of the repeatedly formed print patterns have a same volume and a same ejection speed.

3. The method of claim 1, wherein the print patterns are formed by sequentially ejecting a predetermined number of ink droplets from predetermined nozzles of the inkjet head.

4. The method of claim 1, wherein the print patterns are repeatedly formed at regular intervals.

5. The method of claim 1, wherein the volumes of the ink droplets which correspond to each other in terms of the ejection order are measured by a strobe stand including a light source and a camera.

6. The method of claim 5, wherein the volumes of the ink droplets which correspond to each other in terms of the ejection order are measured from an image captured by the camera after the light source is synchronized with the ink droplets which correspond to each other in terms of the ejection order.

7. The method of claim 1, wherein the volumes of the ink droplets which correspond to each other in terms of the ejection order are measured by a high speed camera.

8. A method of controlling nozzles of an inkjet head, the method comprising:

repeatedly forming print patterns each including a plurality of ink droplets ejected from the nozzles of the inkjet head;

photographing only ink droplets which correspond to each other in terms of an ejection order among ink droplets constituting the print patterns;

measuring the volumes of the photographed ink droplets; and determining driving waveforms of the nozzles corresponding to the print patterns using the measured volumes.

9. The method of claim 8, wherein the ink droplets which correspond to each other in terms of the ejection order among the ink droplets of the repeatedly formed print patterns have a same volume and a same ejection speed.

10. The method of claim 8, wherein the print patterns each are formed by sequentially ejecting a predetermined number of ink droplets from corresponding nozzles.

11. The method of claim 8, wherein the print patterns are repeatedly formed at regular intervals.

12. The method of claim 8, wherein the volumes of the ink droplets which correspond to each other in terms of the ejection order are measured by a strobe stand including a light source and a camera.

13. The method of claim 12, wherein the volumes of the ink droplets which correspond to each other in terms of the ejection order are measured from an image captured by the camera after the light source is synchronized with the ink droplets which correspond to each other in terms of the ejection order.

14. The method of claim 8, wherein the volumes of the ink droplets which correspond to each other in terms of the ejection order are measured by a high speed camera.

15. The method of claim 8, wherein the driving waveforms of the nozzles are determined by controlling at least one of voltages applied to the nozzles and pulse durations.

16. The method of claim 8, wherein the determining of the driving waveforms of the nozzles comprises:

measuring the volumes of the ink droplets of the print pattern and calculating an average volume of the volumes of the ink droplets; and controlling the driving waveforms of the nozzles corresponding to the print patterns so that the average volume of the volumes of the ink droplets is equal to a target volume.

17. The method of claim 8, wherein the determining of the driving waveforms of the nozzles comprises:

measuring the volumes of the ink droplets of the print patterns; and controlling the driving waveforms of the nozzles corresponding to the print patterns so that a sum of the volumes of the ink droplets is equal to a target sum.

18. A method of measuring uniformity of ink droplets corresponding to an inkjet printhead having a plurality of nozzles, the method comprising:

forming a first print pattern by a respective nozzle of the inkjet printhead discharging a first sequence of ink droplets;

forming a second print pattern substantially similar to the first print pattern by the respective nozzle of the inkjet printhead discharging a second sequence of ink droplets;

comparing each ink droplet of the first sequence with a corresponding ink droplet of the second sequence; and measuring a volume for each of the compared ink droplets of the first sequence and the second sequence.

19. The method of claim 18, wherein the comparing of each ink droplet of the first sequence with the corresponding ink droplet in the second sequence comprises:

photographing and overlaying each ink droplet of the first sequence with the corresponding ink droplet in the second sequence.

20. The method of claim 19, further comprising:

determining an average volume of the ink droplets for the respective nozzle based on a sum of the measured volumes for each of the compared ink droplets for the first sequence and the second sequence.

21. The method of claim 20, further comprising:

determining a driving waveform for the respective nozzle using one of the average volume and the sum of volumes being equal to a target volume; and applying the determined driving waveform to the respective nozzle.

22. A computer-readable recording medium having embodied thereon a computer program to execute a method, wherein the method comprises:

forming a first print pattern by a respective nozzle of the inkjet printhead discharging a first sequence of ink droplets;

forming a second print pattern substantially similar to the first print pattern by the respective nozzle of the inkjet printhead discharging a second sequence of ink droplets;

comparing each ink droplet of the first sequence with a corresponding ink droplet of the second sequence; and measuring a volume for each of the compared ink droplets of the first sequence and the second sequence.

23. An inkjet printing system, comprising:

an inkjet printhead having a plurality of nozzles to form a first print pattern by discharging a first sequence of ink droplets, and to form a second print pattern substantially similar to the first print pattern by discharging a second sequence of ink droplets; and a measuring unit disposed proximate to the inkjet printhead to compare each ink droplet of the first sequence with a corresponding ink droplet in the second sequence, and to measure a volume for each of the compared ink droplets of the first sequence and the second sequence.

24. The inkjet printing system of claim 23, wherein the plurality of nozzles of the inkjet printhead are arranged in an angular line with respect to a printing direction.

25. The inkjet printing system of claim 24, wherein the plurality of nozzles of the inkjet printhead are arranged in a perpendicular line with respect to a printing direction.

* * * * *